United States Patent [19]

Jones

[11] Patent Number: 4,825,738

[45] Date of Patent: May 2, 1989

[54] COIL ROLL WRAPPER OPENING METHOD AND TOOL

[75] Inventor: Michael F. Jones, Nashua, N.H.

[73] Assignee: Telequip Corporation, Hollis, N.H.

[21] Appl. No.: 160,865

[22] Filed: Feb. 26, 1988

[51] Int. Cl.[4] ..... B26B 27/00

[52] U.S. Cl. ..... 83/56; 30/2; 30/351; 30/296 R

[58] Field of Search ..... 30/296 A, 296 R, 2, 30/351; 83/13, 56

[56] References Cited

U.S. PATENT DOCUMENTS

| | | | |
|---|---|---|---|
| 2,050,768 | 8/1936 | Seymour | 30/2 |
| 2,660,783 | 12/1953 | Davis et al. | 30/351 |
| 3,403,441 | 10/1968 | Eubanks | 30/351 |
| 3,748,821 | 7/1973 | Hull et al. | 53/159 |
| 3,751,871 | 8/1973 | Hull et al. | 53/26 |
| 3,781,987 | 1/1974 | Gentscheff | 30/2 |
| 3,851,755 | 12/1974 | Hull et al. | 206/82 |
| 4,001,934 | 1/1977 | Bell | 30/124 |
| 4,038,746 | 8/1977 | Bromley | 30/2 |
| 4,040,183 | 8/1977 | Cassier | 30/296 R |
| 4,106,196 | 8/1978 | Smithline | 30/294 |
| 4,333,234 | 6/1982 | Smith et al. | 30/2 |
| 4,382,330 | 5/1983 | Harbaugh | 30/2 |

*Primary Examiner*—Frank T. Yost
*Assistant Examiner*—Scott A. Smith

[57] ABSTRACT

A coin roll opener for opening a plastic wrapper packaging about coins in the form of a roll includes an insert having an elongated, relatively narrow upper surface and at least one corner formed by intersection of the elongated upper surface with a second surface of the insert. In preferred embodiments, the insert is mounted to extend from a body, and two opposed corners are provided. A method for opening a coin roll with the device is also described, whereby a coin roll is rotated in engagement with the corner for initiation of an opening in the plastic wrapper packaging for release of coins.

13 Claims, 1 Drawing Sheet

COIL ROLL WRAPPER OPENING METHOD AND TOOL

The invention relates to a device for opening the packaging material, e.g., paper or plastic, about a roll of coins.

In the past, coins have typically been provided assembled in rolls of specific number, wrapped in paper or the like. Cashiers, tellers, etc. have typically opened paper packaged rolls by striking the roll sharply against an edge, e.g., of the cash drawer, to break the paper package, and then bending the coin roll at the break to sever the package for release of the coins.

More recently, coins have been packaged in shrink-wrap plastic, as described by Hull et al. U.S. Pat. Nos. 3,751,871; 3,748,821 and 3,851,755. This plastic material has been found to be significantly less brittle than the paper packaging, and thus much less easy to open by striking on shelf and counter edges and cash register drawers, or by other means, without special opening devices.

SUMMARY OF THE INVENTION

According to one aspect of the invention, a coin roll opener for opening a plastic wrapper packaging about a plurality of coins in the form of a roll comprises an insert means having an elongated, relatively narrow upper surface and defining at least one corner formed by intersection of the elongated upper surface with a second surface of the insert means, whereby, a coin roll engaged upon the corner is rotated for initiation of an opening in the plastic wrapper packaging for release of coins therefrom.

Preferred embodiments of this aspect of the invention may include one or more of the following features. The coin roll opener further comprises a body member, and the insert means is mounted to extend therefrom, preferably the body member defines a lower base portion and a relatively more narrow upper portion from which the insert means extends, and the upper portion extends above the base portion, whereby the coin roll engaged upon the corner is rotated without engagement of a user's fingers with the body member. The insert means defines an opposed pair of corners. The insert means defines a notch and the opposed corners are defined at the extremities of the notch. The corners are formed at the intersections of the elongated surface of the insert means, and a surface defining the notch. The elongated surface and a surface defining the notch intersect at the corner at an angle of about 90°. The opposed corners are spaced by a distance less than about the diameter of a dime.

According to another aspect of the invention, a method for opening a plastic wrapper packaging about a plurality of coins in the form of a roll comprises the steps of providing a coin roll opener as described above, grasping a coin roll in two hands, disposing the roll in engagement with the corner of the insert means and rotating the coin roll about its axis to initiate an opening in the plastic wrapper, bending the coin roll to increase the opening, and, thereafter, delivering the coins from the package, through the opening.

In preferred embodiments of the method, where the insert means defines a notch with a pair of opposed corners at its extremities, the method comprises engaging the coin roll in the notch. Where the coin roll opener further comprises a body member from which the insert means extends, the method comprises the further step of mounting the body member upon a flat surface convenient to the user.

These and other features and advantages of the invention will be seen from the following description of a presently preferred embodiment and from the claims.

PREFERRED EMBODIMENT

We first briefly describe the drawings.

FIG. 2 is a side view of the coin roll opener of FIG. 1, while

Figure 1:
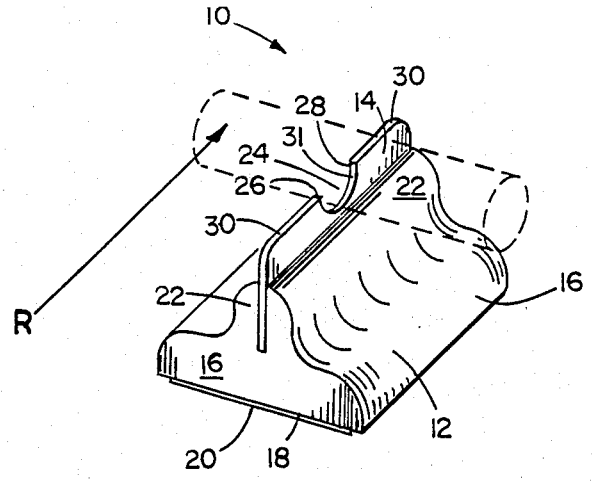
FIG. 1 is a perspective view of a coin roll opener of the invention.
Figure 4:
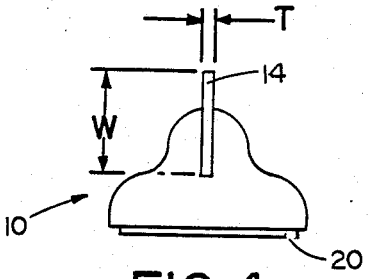
FIGS. 3 and 4 are respective plan and end views of the coin roll opener.
Figure 2:
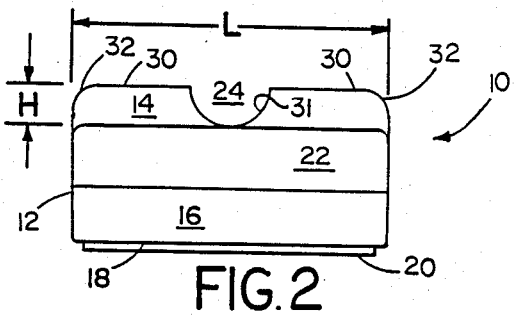
Figure 3:
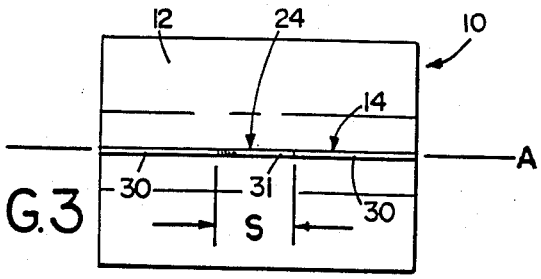

Referring to the drawings, the coin roll opener 10 of the invention consists of a body member 12, e.g., of molded plastic or other suitable material, and an insert 14, e.g., of stainless steel or the like. The body member is about 1.88 inches long by about 1.5 inches wide by about 0.81 inch high at the center, and has a lower, base portion 16 (about 0.38 inch high) defining a generally flat mounting surface 18 and means, e.g., double stick tape 20, for mounting the opener on a flat surface convenient to the user. The body member 12 further has a relatively narrow (about 0.5 inch wide) upper portion 22 from which extends the insert 14. In preferred embodiments, the body 12 may be molded about insert 14, or the body may be formed with an aperture into which the insert is thereafter secured, e.g., by adhesive.

The insert 14 has length, L, width, W, and 0.0625 inch, disposed generally along the longitudinal axis of the body, and extends to a height, H, e.g, about 0.375 inch, above the upper portion 22 of the body member 12. The center portion of the insert 14 defines a notch 24 having a pair of opposed corners 26, 28 where the elongated upper surfaces 30 of the insert 14 intersect the upper surface 31, defining the notch, at significant angles, e.g., approaching 90°. The corners are spaced apart by a distance, S, preferably less than about 11/16 inch (the diameter of a U.S. dime), e.g., 0.625 inch. In the preferred embodiment, the notch has a radius, N, e.g., about 0.31 inch, and the ends 33 of the insert are rounded at the same radius for user safety.

The method of the invention for opening a packaged roll of coins, R, including coins packaged in shrink-wrap plastic, will now be described. Referring to FIG. 1, the opener 10 is mounted on a flat surface convenient to the user by removing facing paper from double face tape 20 on the undersurface 18 of the opener to expose the adhesive-coated surface. The opener is then pressed onto the desired location.

Figure 5:
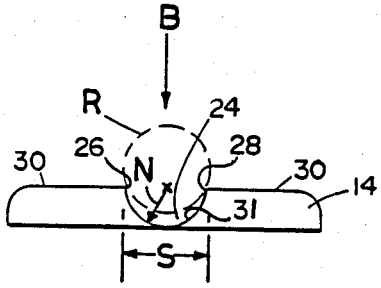
FIGS. 5 and 6 are diagrammatic side views of a sequence for coin roll opening.
Figure 6:
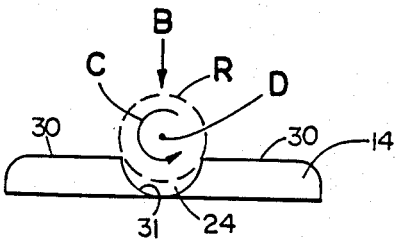

To open a roll of coins, the user holds the packaged roll R in his or her hands and engages the roll in the notch 24, with the roll disposed generally perpendicular to the insert and to the axis, A, of the body of the opener. (The relatively narrow, upper portion 22 of the body extending above the base portion 16 allows the user to easily grasp and manipulate the coin roll to open it without interfering contact with the base.) The roll is then pressed down into the notch (arrow B, FIG. 5) as it is rotated (arrow C, FIG. 6) about its axis, D, with the wrapping material in engagement with the corners, to initiate an opening in the wrapper. The user may then simply open the coin roll package to release the coins in the usual manner, by bending the coin roll at the initial opening.

Other embodiments are within the following claims. For example, a coin roll opener of the invention may consist of the insert constructed for mounting by other means, e.g., by attachment to a shelf or to the edge of a cash drawer.

What is claimed is:

1. A coin roll opener for opening a plastic wrapper packaging about a plurality of coins in the form of a roll, comprising providing a coil roll opener comprising an insert means having an elongated relatively narrow upper surface and defining a notch having a pair of opposed corners formed by intersection of said elongated upper surface with second surfaces of said insert means, grasping a coil roll in two hands, disposing the grasped coil roll in engagement with the corners of the notch of the insert means in a manner to pinch the plastic wrapper packaging between said corner and coins in the coil roll and rotting the coil roll about its axis to initiate an opening in the plastic wrapper, bending the coil roll to increase the opening, and, thereafter, delivering the coins from the package, through the opening.

2. The method of claim 1 wherein the coin roll opener further comprises a body member from which the insert means extends, and said method comprises the further step of mounting said body member upon a flat surface convenient to the user.

3. A coin roll opener for opening a plastic wrapper packaging about a plurality of coins in the form of a roll, comprising an insert means having an elongated, relatively narrow upper surface and defining at least one corner formed by intersection of said elongated upper surface with a second surface of said insert means, said second surface being intermediate two ends of said elongated upper surface, said corner adapted for engagement by a roll of coins, with plastic wrapper packaging pinched between said corner and coins in a coil roll, whereby, as the coil roll engaged upon said corner is rotated, opening of the plastic wrapper packaging for release of coins therefrom is initiated.

4. The coin roll opener of claim 3 wherein said coin roll opener further comprises a body member, and said insert means is mounted to extend therefrom.

5. The coin roll opener of claim 4 wherein said body member defines a lower base portion and a relatively more narrow upper portion from which said insert means extends, and said upper portion extends above said base portion, whereby said coin roll engaged upon said corner is rotated without engagement of a user's fingers with the body member.

6. The coin roll opener of claim 3 or 4 wherein said insert means defines an opposed pair of said corners.

7. The coin roll opener of claim 6 wherein said insert means defines a notch and said opposed corners are defined at the extremities of said notch.

8. The coin roll opener of claim 6 wherein said corners are formed at the intersections of the elongated surface of said insert means and said second surface.

9. The coin roll opener of claim 6 wherein said elongated surface and said second surface intersect at said corners at an angle of about 90°.

10. The coin roll opener of claim 6 wherein said opposed corners are spaced by a distance less than about the diameter of a dime.

11. A coin roll opener for opening a plastic wrapper packaging about a plurality of coins in the form of a roll, comprising an insert means having an elongated, relatively narrow upper surface and a notch defining a second surface having opposed corners formed at the extremities of said notch by intersection of said elongated upper surface with said second surface of said insert means, said opposed corners spaced apart by a distance less than the diameter of coins within a roll to be opened and adapted for engagement by a roll of coins with plastic wrapper packaging pinched between each said corner and interposed coins in the coin roll, whereby, as the coin roll engaged upon said corners of said notch is rotted, opening of the plastic wrapper packaging for release of coins therefrom is initiated.

12. The coin roll opener of claim 11 wherein said opposed corners are spaced apart by a distance less than about the diameter of a dime.

13. The coin roll opener of claim 11 wherein said second surface is an arcuate surface defining said notch.

* * * * *

UNITED STATES PATENT AND TRADEMARK OFFICE

CERTIFICATE OF CORRECTION

PATENT NO. : 4,825,738

DATED : May 2, 1989

INVENTOR(S) : Michael F. Jones

It is certified that error appears in the above-identified patent and that said Letters Patent is hereby corrected as shown below:

Col. 2, line 20, "The body member" should start a new paragraph.

Col. 2, line 32, after "and" insert --thickness T, e.g., about 1.875 inches x 0.75 inch x--.

Col. 3, line 22, "rotting" should be --rotating--.

Signed and Sealed this

Twenty-sixth Day of December, 1989

*Attest:*

JEFFREY M. SAMUELS

*Attesting Officer* *Acting Commissioner of Patents and Trademarks*